US005086972A

United States Patent [19]

Chang et al.

[11] Patent Number: 5,086,972

[45] Date of Patent: Feb. 11, 1992

[54] ENHANCED ELECTROSTATIC PAINT DEPOSITION METHOD AND APPARATUS

[75] Inventors: David B. Chang, Tustin; James E. Drummond, Oceanside, both of Calif.

[73] Assignee: Hughes Aircraft Company, Los Angeles, Calif.

[21] Appl. No.: 561,118

[22] Filed: Aug. 1, 1990

[51] Int. Cl.[5] ..... B05B 5/025; B05B 5/053

[52] U.S. Cl. ..... 239/3; 239/690; 239/698; 239/708

[58] Field of Search ..... 239/3, 690, 697, 698, 239/708

[56] References Cited

U.S. PATENT DOCUMENTS

| | | | |
|---|---|---|---|
| 2,890,388 | 6/1959 | Croskey et al. | 239/3 X |
| 3,049,301 | 8/1962 | Heuschkel | 239/708 |
| 3,195,264 | 7/1965 | Ward, Jr. | 239/3 X |
| 3,764,068 | 10/1973 | Lacchia | 239/3 |
| 4,066,041 | 1/1978 | Buschor et al. | 239/708 X |
| 4,245,784 | 1/1981 | Garcin | 239/3 |
| 4,310,474 | 1/1982 | Iyengar | 239/697 X |
| 4,402,991 | 9/1983 | Meisner | 239/3 X |
| 4,440,349 | 4/1984 | Sickles et al. | 239/698 |
| 4,735,364 | 4/1988 | Marchant | 239/708 X |
| 4,736,209 | 4/1988 | Glenn et al. | 239/690 X |
| 4,776,515 | 10/1988 | Michalchik | 239/3 |

FOREIGN PATENT DOCUMENTS

| | | | |
|---|---|---|---|
| 569700 | 1/1959 | Canada | 239/3 |

*Primary Examiner*—Robert P. Olszewski
*Assistant Examiner*—William Grant
*Attorney, Agent, or Firm*—Michael W. Sales; Wanda K. Denson-Low

[57] ABSTRACT

An enhanced electrostatic paint deposition apparatus (10) comprising a nozzle (16), a conduit (14) coupled to the nozzle for supplying paint (12) thereto, and a plurality of electrically conductive whiskers (18) positioned within the nozzle for applying an electrostatic charge to droplets of the paint. Each of the whiskers terminates in a jagged end (30) for enabling the droplets to acquire an enhanced electric charge. The whiskers may be provided with lengths which are tailored to provide an array of whiskers with a desired three-dimensional curvature for controlling the focussing field on the paint droplets. Each whisker is secured to a holder (22) which is, in turn, secured to a porous grid (20) whose mesh size is selected to divide that paint into narrow streams of desired size, which exit nozzle 16 in droplet form. The holder is configured by decreasing its center portion (28) in dimension to tume the holder's current limiting capabilities. Pulsed negative high voltage is applied to the whiskers for enabling them to negatively charge the paint. Phased deflector plates 22, 24, 26 are provided to steer the paint stream.

17 Claims, 3 Drawing Sheets

ENHANCED ELECTROSTATIC PAINT DEPOSITION METHOD AND APPARATUS

BACKGROUND OF THE INVENTION

The present invention relates to electrostatic painting of surfaces and, more particularly, to an improved apparatus and method for such painting which causes the paint to be more efficiently focussed and applied onto the surfaces.

Conventional charge injectors include a needle located at and projecting from the spray end of a rotating paint nozzle, which has a bulbous shape. As the nozzle rotates, the paint is ejected generally tangentially to the curvature of the nozzle and across the electrode which charges the droplets. This causes the droplets to be thus spread over a wide area of the surface to be painted. The shape of the envelope surface formed by the taper of the charging electrode within the paint flow conventionally is that of the standard Pierce electrode as described, for example, in "Applied Charged Particle Optics, Part C: Very-High-Density Beams" edited by A. Septier, Academic Press, 1983, pp. 141 et seq. and pp. 207 et seq. It results in paint droplets having a charge to mass ratio of only about 0.0004 C/g (Coulombs per gram), or one extra electron for about every billion atoms. By contrast, advanced electrostatic precipitators deposit ten times this amount on 0.1 micrometer sized fly ash particles; but even this is an order of magnitude less than the theoretical limit set by electrical breakdown of the air around a particle.

While such electrodes produce acceptable results, it is desirable that the costs thereof be reduced and that the painting be made more efficient. In the manufacture of motor vehicles, these desires stem from a need to produce a more competitively priced product. Further, there is a need to devise better methods for facilitating easier compliance with the EPA (Environmental Protection Agency) requirements for allowed quantity of volatile material released per square foot of surface painted.

SUMMARY OF THE INVENTION

The present invention improves upon such electrostatic painting by use of an apparatus and method for supplying paint to a plurality of electrically conductive whiskers and by applying an electrostatic charge to the paint.

Specifically, the enhanced electrostatic paint deposition apparatus comprises a nozzle, a conduit coupled to the nozzle for supplying paint thereto, and a plurality or array of electrically conductive whiskers positioned within the nozzle for applying an electrostatic charge to the paint. Each of the whiskers terminates in a jagged end, for enhancing the electric field strength and, thus, for enabling them to dispense charges to the paint with smaller applied voltage than would otherwise be the case. The lengths of the array of whiskers may be tailored to provide them with a specific three-dimensional curvature to control the focussing field on the paint. Each whisker is secured to a holder which is, in turn, secured to a porous grid. The holder is configured to tune the holder's current limiting capabilities. The grid is designed to break the paint into narrow streams which exit the nozzle as negatively charged droplets of paint for deposit onto a surface to be painted, such as on an automobile.

Several advantages are derived from this apparatus and construction. Because the whiskers of the present invention are much finer than the needle used in conventional apparatus, they can produce local plasmas within the liquid and can be packed so closely that a much larger charge to mass ratio can be produced. This produces an increase in charge to mass ratio on the droplets of paint from 0.0004 C/g for conventional apparatus up to about 100 times that amount, for the apparatus of the present invention. This will allow better control and higher efficiency of paint application. The better control enables the droplets to be more accurately focussed onto the surface to be painted, not only to provide a uniform coverage but also to provide heavier or lighter coating, depending upon the topography of the surface. The cost of paint is reduced. Compliance with Environmental Protection Agency (EPA) requirements regarding allowed quantity of volatile material released per square foot of surface painted can be more easily achieved.

Other aims and advantages, as well as a more complete understanding of the present invention, will appear from the following explanation of an exemplary embodiment and the accompanying drawings thereof.

DETAILED DESCRIPTION OF THE INVENTION

Figure 1:
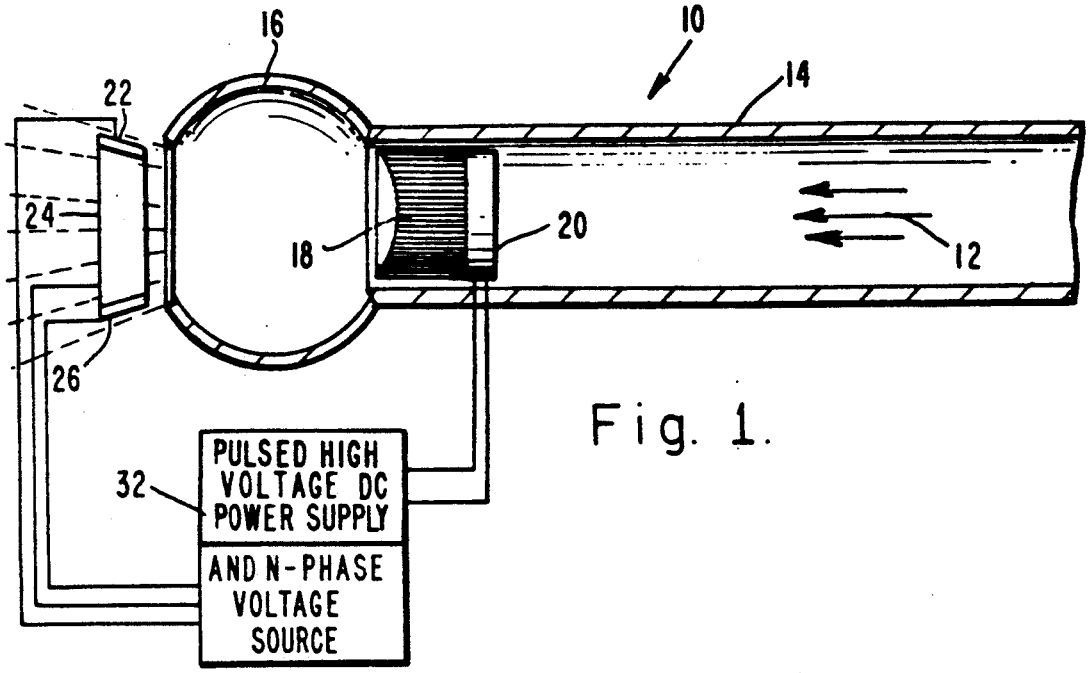
FIG. 1 is a view in cross-section of a preferred embodiment of the present invention, including the use of a plurality of metallic whiskers.
Figure 5:
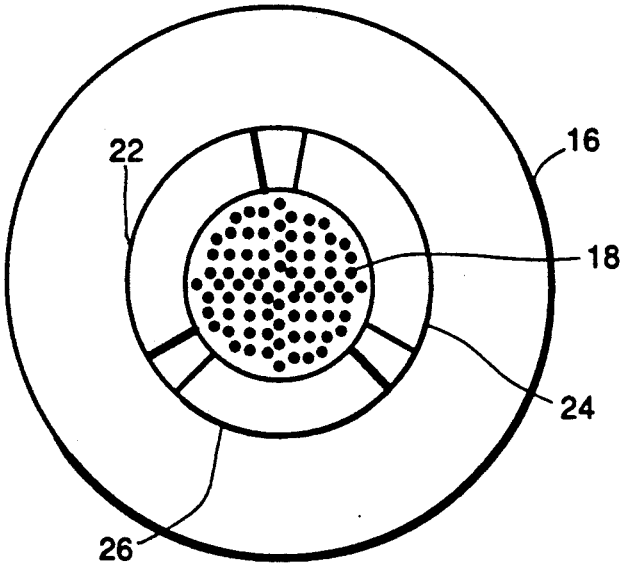
FIG. 5 is a front view of the preferred embodiment of the invention shown in FIG. 1

FIG. 1 depicts an apparatus 10 for electrostatically applying paint to a surface, such as a shell of an automobile. FIG. 5 is a front view of the preferred embodiment of the invention shown in FIG. 1. Paint flows in a direction as denoted by arrows 12, from a source (not shown) of the paint through a conduit 14 to a nozzle 16 of bulbous configuration. This arrangement is conventional with respect to electrostatic paint spraying equipment using a single needle and a mechanism which rotates the nozzle at a high speed.

In the present invention, however, alternative means for spinning the emitted paint flow is provided; and in place of the conventional needle of relatively large diameter in existing paint spraying equipment, the present invention utilizes a plurality of metallic whiskers 18, typically of 0.001 to 0.002 mm diameter, and composed, for example, of titanium, graphite, tin or tungsten. Whiskers 18 are secured to a grid 20 of porous electrically conductive material, which is so sized as to break the paint into narrow jets.

The grid is of conventional design, to assure proper support of whiskers 18 and to permit flow of paint in the form of narrow jets through it. The openness of the grid is dependent upon the viscosity of the paint, that is, as the paint increases in viscosity, the openness of the grid is correspondingly increased. A typical ratio of openness to grid material provides for a 90% flow area and 10% grid material, such as a mesh ranging from 0.005 to 0.015 mm.

Figure 2:
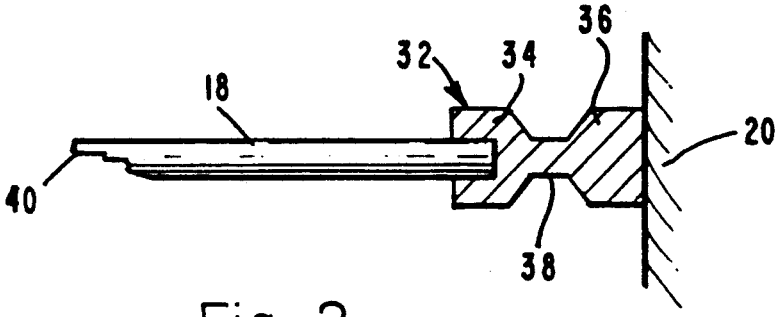
FIG. 2 is a detail view of one of the whiskers and its connection to a supporting grid.

As depicted in FIG. 2, each whisker 18 is secured to grid 20 by a holder 32. Holder 32 comprises a resistive material and acts as a current limiter to prevent any one whisker from drawing excessive current. The securing of whisker 18 to holder 32 may be effected by a cup-shaped receptacle 34, and the holder is secured at its end 36 to grid 20 by any suitable bonding means. The holder has a center section 38 which may be of lesser cross-sectional dimension so as to tune the holder's current limiting capabilities.

The lengths of the whiskers may be tailored to provide them with a specific three-dimensional curvature to control the focussing field on the paint droplets. It is further preferred that the whiskers have ends 40 which are uneven, that is, jagged, to help charges to be dispensed to the paint. Because the whiskers are single crystals of very regular structure, when their ends are broken sharp corners result.

Figure 3:
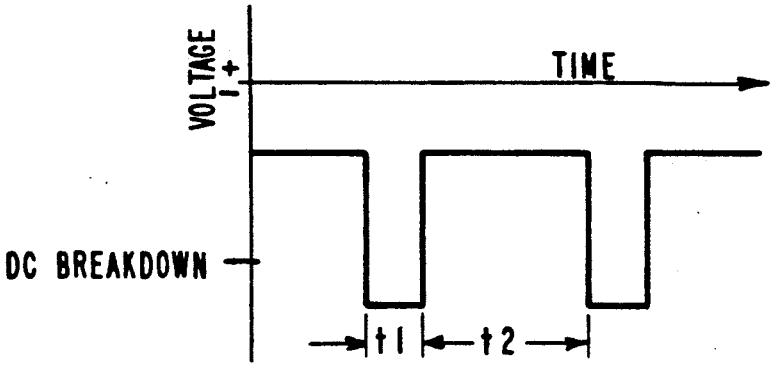
FIG. 3 illustrates a desirable pulse profile of a power supply for applying a negative charge to the whiskers and, thus, to the paint.

Grid 20 is coupled to a pulsed power supply 32 of high negative voltage direct current as shown in FIG. 3. Pulsing allows higher voltage to be used provided that the pulse duration is less than the time for electrical breakdown within the paint. Emission increases rapidly with voltage; therefore, there is a net gain in charging rate, which also occurs in a similar manner in electrostatic precipitators. As shown in FIG. 3, the excess voltage charging time t1 and relaxation time t2 can be adjusted by electronic circuitry of conventional design to maximize the charging rate with acceptable sparking rate (1/minute) as is common for electrostatic precipitators. The adjustments will depend upon the dielectric properties of the paint and its flow rate.

Figure 4:
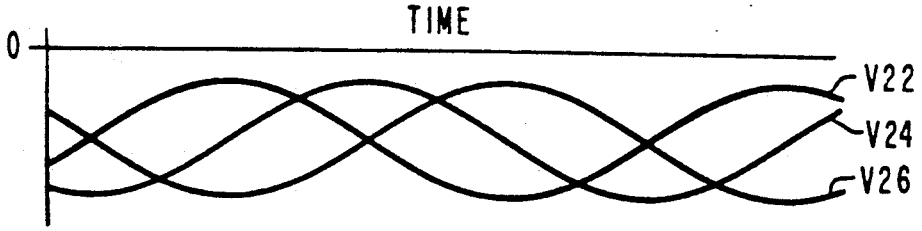
FIG. 4 illustrates a three-phase voltage excitation scheme to be applied to the deflection plates.

Referring again to FIG. 1, if desired, electrostatic steering and/or rotation of the flow may be added, such as by the addition of deflectors 22, 24 and 26 powered by conductors (not shown) placed in a ring-like fashion or otherwise about the exit opening 17, to steer the droplets upon exit from nozzle 16 in a desired manner to the surface to be painted. FIG. 4 illustrates one scheme of voltage excitation which could be applied to the deflectors, i.e. a three phase excitation. Of course alternative schemes could be used, but in most cases it would be preferred that the number (N) of phases of voltage used would equal the number of deflection plates used.

The use of a plurality of whiskers 18 improves the charge to mass ratio of paint to be applied to the surface. By charge to mass ratio is meant the amount of charge which can be placed on a droplet of paint, divided by the mass which affects the inertia of the droplet. Because the charge to mass ratio is directly proportional to acceleration of the droplets, as this ratio increases, the droplets can be better directed to the surface.

Although the invention has been described with respect to a particular embodiment thereof, it should be realized that various changes and modifications may be made therein without departing from the spirit and scope of the invention.

What is claimed is:

1. An enhanced electrostatic paint deposition apparatus comprising:

a nozzle;

a conduit coupled to said nozzle for supplying paint thereto; and a plurality of electrically conductive whiskers formed in a three-dimensional curved array for applying an electrostatic charge to the paint and for focussing the paint.

2. An enhanced electrostatic paint deposition apparatus according to claim 1 in which each of said whiskers terminates in a jagged end for enabling the paint to acquire an enhanced electric charge.

3. An enhanced electrostatic paint deposition apparatus according to claim 2 in which the lengths of said whiskers are tailored to provide them with the three-dimensional curvature for controlling the focussing field on the paint.

4. An enhanced electrostatic paint deposition apparatus according to claim 1 further comprising a grid formed of porous electrically conductive material for supporting said whiskers and for breaking the paint into narrow streams.

5. An enhanced electrostatic paint deposition apparatus according to claim 4 further comprising a pulsed power supply of high voltage electrically coupled to the grid for supplying a charge to said grid.

6. An enhanced electrostatic paint deposition apparatus according to claim 5 in which said power supply is configured to provide a pulse duration time which is less than the time for electrical breakdown within the paint.

7. An enhanced electrostatic paint deposition apparatus according to claim 5 further comprising means for connecting said whiskers to said grid and for preventing any of said whiskers from drawing excessive current wherein said connecting means comprises separate holders in which each of said holders connects one of said whiskers to said grid, each said holder comprising a resistive material secured at its ends respectively to said whisker and to said grid and having a portion intermediate said ends, said intermediate portion being narrowed to define a desired current limiting value.

8. An enhanced electrostatic paint deposition apparatus according to claim 7 in which each of said whiskers terminates in a jagged end for enhancing the deposition of negative charges onto the paint passing by said whiskers.

9. An enhanced electrostatic paint deposition apparatus according to claim 8 in which the lengths of said whiskers are tailored to provide them with the three-dimensional curvature for controlling the focussing field on the paint.

10. An enhanced electrostatic paint deposition apparatus according to claim 9 in which each of said whiskers consists of a single crystal of a material selected from the group of titanium, graphite, tin and tungsten.

11. A method for enhancing electrostatic paint deposition comprising the steps of:

providing a plurality of electrically conductive whiskers formed in a three-dimensional curved array;

positioning the plurality of electrically conductive whiskers in a conduit;

supplying paint to said plurality of electrically conductive whiskers; and applying an electrostatic charge to the paint with the whiskers.

12. The method of claim 11 wherein each of the whiskers is terminated in a jagged end for enabling the paint to acquire an enhanced electric charge.

13. The method according to claim 12 further comprising the step of providing the whiskers with lengths which are tailored to provide them with the three-dimensional curvature for controlling the focussing field on the paint.

14. A paint deposition apparatus comprising:

a nozzle;

a conduit coupled to said nozzle for supplying paint thereto;

a plurality of electrically conductive whiskers for applying electrostatic charges to the paint; and a set of at least three deflecting plates disposed in a circle about the perimeter of the exit opening of said nozzle, said plates coupled to a source of voltage, for deflecting and rotating drops of paint emitted from said nozzle.

15. An enhanced electrostatic paint deposition apparatus comprising:

a nozzle;

a conduit coupled to said nozzle for supplying paint thereto; and a plurality of electrically conductive whiskers for applying an electrostatic charge to the paint, in which each of said whiskers is a single metallic crystal which terminates in a jagged end for enabling the paint to acquire an enhanced electric charge.

16. An enhanced electrostatic paint deposition apparatus comprising:

a nozzle;

a conduit coupled to said nozzle for supplying paint thereto;

a plurality of electrically conductive whiskers for applying an electrostatic charge to the paint;

a pulsed power supply for supplying charge to said whiskers; and resistor means for holding the whiskers and for limiting the current applied to the whiskers.

17. An enhanced electrostatic paint deposition according to claim 16 in which said power supply is configured to provide a pulse duration time which is less than the time for electrical breakdown within the paint.

* * * * *